United States Patent [19]

Satake et al.

[11] Patent Number: 4,591,888

[45] Date of Patent: May 27, 1986

[54] HEAT-SENSITIVE RECORDING SHEET

[75] Inventors: Toshimi Satake; Toshiaki Minami; Fumio Fujimura, all of Tokyo, Japan

[73] Assignee: Jujo Paper Co., Ltd., Tokyo, Japan

[21] Appl. No.: 650,793

[22] Filed: Sep. 14, 1984

[30] Foreign Application Priority Data

Sep. 16, 1983 [JP] Japan ..... 58-169269

[51] Int. Cl.[4] ..... B41M 5/18

[52] U.S. Cl. ..... 346/209; 346/210; 346/212; 346/216; 346/217; 346/220; 346/225; 427/150; 427/151

[58] Field of Search ..... 346/208–212, 346/216–218, 220, 221, 225; 427/150–152

[56] References Cited

U.S. PATENT DOCUMENTS 3,871,900 3/1975 Hayashi et al. ..... 346/216

*Primary Examiner*—Bruce H. Hess

*Attorney, Agent, or Firm*—Koda and Androlia

[57] ABSTRACT

Heat-sensitive recording sheet comprising a base sheet a color-forming layer including a colorless basic dyestuff and an organic color-developing agent, wherein said color-forming layer comprises a metal salt derivative of nitrobenzoic acid (having a particular formula). The sheet provides superior stability against contamination with oily substances while keeping excellent fundamental qualities thereof.

15 Claims, No Drawings

HEAT-SENSITIVE RECORDING SHEET

BACKGROUND OF THE INVENTION

1. Field of the Invention

The present invention relates to a heat-sensitive recording sheet having high stability of background brightness and of developed image against oily substances such as hair oil, oil, fat, etc.

2. Prior Art

A heat-sensitive recording sheet that utilizes a thermal color-forming reaction occurring between colorless or pale-colored chromogenic dyestuff and phenolic material, or organic acid is disclosed, for example, in the Japanese Patent Publication Nos. 4160/1968 and 14039/1970 and in the Japanese Laid-Open Patent Application No. 27736/1973, and is now widely applied for practical use.

In general, a heat-sensitive recording sheet is produced by applying the sheet surface with the coating which is prepared by individually grinding and dispersing colorless chromogenic dyestuff and color-developing material such as phenolic substance into fine particles, mixing the resultant dispersions with each other and then adding thereto binder, filler, sensitizer, slipping agent and other auxiliaries. When this sheet is heated, the coating undergoes instantaneously a chemical reaction which forms a color. In this case, various bright colors can be advantageously formed depending upon selection of specific colorless chromogenic dyestuff.

These heat-sensitive recording sheets have now been found in a wide range of applications, including medical or industrial measurement recording instruments, terminal printers of computer and information communication systems, facsimile equipments, printers of electronic calculators, automatic ticket vending machines and so on.

Heat-sensitive recording sheets are inevitably in contact with human hands in view of the function thereof as information recording sheets. Since oily substances such as conventionally used hair cosmetics or oil and fats contained in sweats appearing on skins often adhere to the hands and fingers, the heat-sensitive recording sheets may frequently be contamined by these oily substances. By the way, since heat-sensitive recording sheets are not generally so stable against these oily substances, image density in the contaminated area may be reduced or sometimes be eliminated utterly, or discoloration occurs in the contaminated white area. Although the reasons for the above phenomena have not yet been cleared completely at present, it may be considered that the oily substances partially dissolve or instabilize the chromophoric layer or the chromophoric reaction products therein formed between fine particles of a colorless basic dyestuff and an organic color-developing agent.

SUMMARY OF THE INVENTION

It is a general object of the present invention to provide a heat-sensitive recording sheet which is stable against contamination with the oily substance.

The above-mentioned object can be performed by adding into the color-forming layer a metal salt derivative of a nitrobenzoic acid represented by the following formula (I) or (II):

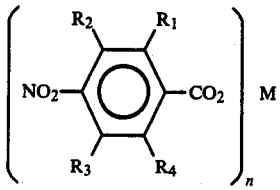

(I)

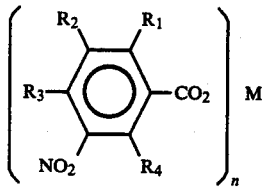

(II)

where $R_1$, $R_2$, $R_3$ and $R_4$ represent individually H, $NO_2$, halogen group, alkoxyl group, $CH_3$, $C_2H_5$, $C_3H_7$, iso-$C_3H_7$, tert-$C_4H_9$, $C_5H_{11}$ or

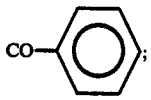

M a polyvalent metal; and n represents an integer of 2 or 3.

The above metal salt derivative of nitrobenzoic acid provides both high color-developing ability and superior stability for recorded images, brightness of background, etc., so that it may be used as a color-developing agent and/or it may improve the stability in combination with other color-developing agent than a metal salt derivative of nitrobenzoic acid.

DETAILED DESCRIPTION OF THE INVENTION

This invention will be described more in detail. Other organic color-developing agents than a metal salt derivative of nitrobenzoic acid, which are used in this invention, have no particular restriction and, while any kind of color-developing agent may be used, most significant effect of this invention can be obtained by using, as the developing agent, a mono-phenolic 4-hydroxyphenyl compound or phthalic acid mono-ester which provide the advantage of satisfying fundamental requirements for the quality of heat-sensitive recording paper, that is, being capable of obtaining clear recording image at high density, free from troubles such as adhesion or sticking to the thermal head, excellent in the recording aptitude, as well as diminishing the fading with time.

This invention will now be described more specifically. Mono-phenolic 4hydroxyphenyl compounds to be used as the color-developing agent in this invention include, for example, 4-hydroxybenzoic acid esters such as ethyl 4-hydroxybenzoate, propyl 4-hydroxybenzoate, isopropyl 4-hydroxybenzoate, butyl 4-hydroxybenzoate, isobutyl 4-hydroxybenzoate, benzyl 4-hydroxybenzoate and methylbenzyl 4-hydroxybenzoate; 4-hydroxyphthalic acid diesters such as dimethyl 4-hydroxyphthalate, diisopropyl 4-hydroxyphthalate, dibenzyl 4-hydroxyphthalate and dihexyl 4-hydroxyphthalate; and 4-hydroxyacetophenone, p-phenylphenol, benzyl 4-hydroxyphenyl acetate and p-benzylphenol; 4-hydroxyphenyl-4'-n-butyloxyphenylsulfone, 4-hydroxyphenyl-4'-n-hexyloxyphenylsulfone, 4-hydroxyphenyl-4'-n-octyloxyphenylsulfone, 4-hydroxyphenyl-4'-n-decyloxyphenylsufone, 4-hydroxyphenyl-4'-n-dodecyloxyphenylsulfone, 4-hydroxyphenyl-4'-benzyloxyphenylsulfone, 4-hydroxyphenyl-4'-P-isopropylbenzyl oxyphenylsulfone, 4-hydroxyphenyl-4'-β-phetyloxyphenylsulfone, 4-hydroxyphenyl-4'-β-ethoxyethyloxyphenylsulfone, 4-hydroxyphenyl-4'-β-butoxyethyloxyphenysulfone, 4-hydroxyphenyl-4'-β-phenoxyethyloxyphenylsulfone, 4-hydroxyphenyl-4'-o-chlorobenzoyloxyphenylsulfone, 4-hydroxyphenyl-4'-β-t-butylbenzoyloxyphenylsulfone, 4-hydroxyphenyl-4'-β-t-octylbenzoyloxyphenysulfone, 4-hydroxyphenyl-4'-lauroyloxyphenylsulfone, 4-hydroxyphenyl-4'-decanoyloxyphenylsulfone, 4-hydroxyphenyl-4'-myristoyloxyphenylsulfone, 4-hydroxyphenyl-4'-stearyloxyphenylsulfone, 4-hydroxyphenyl-4'-β-phenoxy propionyloxyphenylsulfone, 4-hydroxyphenyl-4'-hexadecylsulfonyloxyphenylsulfone, 4-hydroxyphenyl-4'-decylsulfonyloxyphenylsulfone, 4-hydroxyphenyl-4'-p-toluenesulfonyloxyphenylsulfone, 4-hydroxyphenyl-4'-p-isopropylbenzenesulfonyloxyphenylsulfone, 4-hydroxyphenyl-4'-(4-p-t-butylphenoxybutyloxy)phenylsulfone. 4-hydroxyphenyl-4'-(4-p-t-amylphenoxybutyloxy)phenylsulfone, 4-hydroxyphenyl-4'-(5-p-t-butylphenoxyamyloxy)phenylsulfone, 4-hydroxyphenyl-4'-(6-p-t-butylphenoxyhexyloxy)phenylsulfone.

And phthalic acid monoester to be used as the color-developing agent in this invention include, for example, phthalic acid monophenylester, phthalic acid monobenzylester, phthalic acid monocyclohexylester, phthalic acid monomethylphenylester, phthalic acid monoethylphenylester, phthalic acid monoalkyl benzylester, phthalic acid monohalogenbenzylester phthalic acid monoalkyoxybenzylester, and the like.

Although these color developing agent are excellent in the fundamental requirements for the quality, they involve a drawback in that its stability against the oily substance is somewhat inferior to that of the bisphenol type color-developing agent customarily used so far.

Furthermore, although the bisphenol compounds can include, for example, 4,4'-isopropylidene diphenol (bisphenol-A), 4,4'-(1-methyl-n-hexylidene)diphenol, 4,4'-cyclohexylidene diphenol and 4,4'-thiobis(4-tertbutyl-3-methylphenol), even these color developing agent still have no sufficient stability against the oily substance in the combination with a colorless dye which is considered to have a somewhat lower color developing property.

The stability against the oily substance as described above can significantly be improved by the combined use of the metal salt derivative of the nitrobenzoic acid according to this invention.

As colorless basic dyestuffs for use in this invention which are usually colorless or of pale color, various types of dyestuff are well-known and can be used with no particular restriction. For instance, colorless fluoran type dyestuffs include the followings: 3-diethyl-amino-6-methyl-7-anilinofluoran (black), 3-(N-ethyl-p-toluidino)-6-methyl-7-anilinofluoran (black), 3-diethylamino-6-methyl-7-(o-, p-dimethylanilino)fluoran (black), 3-pyrrolidino-6-methyl-7-anilinofluoran (black), 3-piperidino-6-methyl-7-anilinofluoran (black), 3-(N-cyclohexyl-N-methylamino)-6-methyl-7-anilinofluoran (black), 3-diethyl-amino-7-(methatrifluoromethylanilino)fluoran (black), 3-dibutylamino-7-(orthochloroanilino)fluoran (black), 3-diethylamino-6-methyl-chlorofluoran (red), 3-diethylamino-6-methyl-fluoran (red) and 3-cyclohexylamino-6-chloro-fluoran (orange).

Among fluoran type black color forming dyestuff, 3-diethylamino-6-methyl-(p-chloroanilino)fluoran, 3-diethylamino-7-(o-chloroanilino)fluoran, 3-(n-ethyl-p-toluidino)-6-methyl-7-anilinofluoran, 3-dibutylamino-6-methyl-(o-chloroanilino)fluoran, 3-(N-ethyl-isoamyl-)amino-6-methyl-7-anilinofluoran and the like give somewhat insufficient image density. The stability against oily material and the image density can be improved by the addition of the metal salt derivative of nitrobenzoic acid specified in this invention into the color-developing layer.

Furthermore, these colorless basic dyestuffs other than the fluoran type dyestuffs can also be used in this invention. Specifically, while it has been impossible to use crystal violet lacton, methyl violet lacton, 3-(4-diethylamino-2-ethoxyphenyl)-3-(1-ethyl-2-methylindol-3-yl) 4-azaphthalide and 3-(4-diethylamino-2-ethoxyphenyl)-3-(1-ethyl-2-methylindol-3-yl)-7-azaphthalide and the like in combination with the color-developing agent of mono-phenolic 3-hydroxyphenyl compound or phthalic acid monoester, since thermochromic phenomenon occurs in which the color images are eliminated immediately or gradually after the printing to make it impossible for the heat-sensitive recording sheets. However, such thermochromic phenomenon can be prevented by the use of the metal salt derivative of nitrobenzoic acid specified in this invention.

Further, in using a metal salt derivative of nitrobenzoic acid of this invention as a color-developing agent, the combined use of at least one dyestuff selected from the group consisting of crystal violet lacton, fluorene type leuco dyestuff and azaphthalide type leuco dyestuff provides superior effect of improving stability against oily contamination.

In recent years, the colorless basic dyestuffs which absorb the light of infrared regions (particularly, near infrared regions of 700–1000 nm) in color-forming by melt-reaction with heat, have been developed. They are used effectively in this invention.

Particularly, fluorene type leuco dyestuffs having the general formula (III) or (IV) are excelent among colorless basic dyestuff having such property.

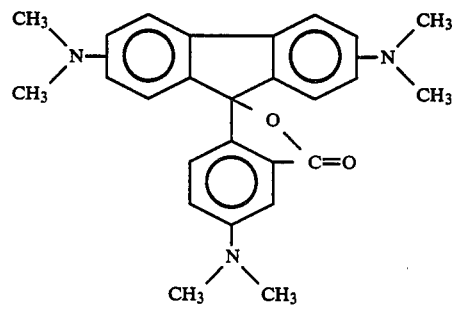

(III)

-continued

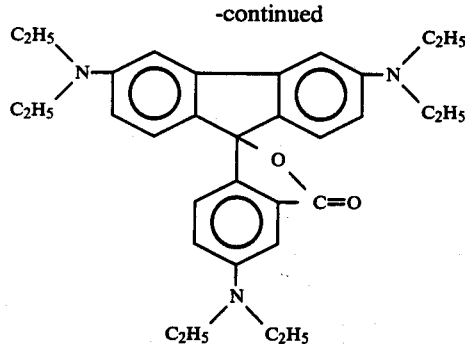

(IV)

The metal salt derivative of nitrobenzoic acid used in this invention is very effective as a color-developing agent and has the features that it absorbs infrared ray more than other color-developing agents and that is provides stable recored images and superior stability against oily contamination.

The combined use of fluorene type leuco dyestuff having the formula (III) or (IV) and other colorless basic dyestuff described above provides the developed images in the range of visible light to near infrared ray.

The metal salt derivative of nitrobenzoic acid to be used in this invention is that as described in above general formula (I) or (II), and includes, for example, metal salt derivative of 4-nitrobenzoic acid, 3-nitrobenzoic acid, 3,4-dinitrobenzoic acid, 4-nitro-3-methylbenzoic acid, 4-nitro-5-methyl-benzoic acid, 3,5-dinitrobenzoic acid, 2-benzoyl-4-nitrobenzoic acid, 2-benzoyl-3-nitrobenzoic acid, 4-t-butyl-3-nitrobenzoic acid, 4-t-butyl-3,5-dinitrobenzoic acid, 3-nitro-4-methylbenzoic acid, 3-nitro-5-methylbenzoic acid, 3-nitro-2-methylbenzoic acid, 4-nitro-5-chlorobenzoic acid, 4-nitro-2-chlorobenzoic acid, 4-nitro-5-chlorobenzoic acid, 3-nitro-4-chlorobenzoic acid, 3-nitro-5-chlorobenzoic acid, etc., and the metal salt derivative of 3-nitrobenzoic acid and that of 4-nitrobenzoic acid are preferred.

Any polyvalent metal, such as zinc, calcium magnesium, aluminum, barium, lead, etc. may be used as the metal, and zinc, calcium and magnesium are excellent. One or more of metal salt derivative of nitrobenzoic acids as described above are employed.

The organic color-developing agent and the colorless basic dyestuff, as well as the metal salt derivative of nitrobenzoic acid as mentioned above are finely pulverized in a grinder such as ball mill, an attritor, a sand grinder or the like, or in an appropriate emulsifying apparatus into fine particles of less than several micron particle size and incorporated with various types of additives depending on the purposes to prepare a coating solution. The coating solution may usually be incorporated with binders such as polyvinyl alcohol, modified polyvinyl alcohol, hydroxyethylcellulose, methylcellulose, starches, styrene-maleic anhydride copolymer, vinylacetate-maleic anhydride copolymer and styrenebutadiene copolymer, as well as organic or inorganic filler such as kaolin, calcined kaolin, diatomaceous earth, talc, titanium oxide, calcium carbonate, magnesium carbonate and aluminum hydroxide. In addition, releasing agent such as metal salt of fatty acid, lubricant such as waxes, UV-absorber of benzophenone or triazole type, water-proofing agent such as glyoxal, dispersant, defoamer or the like can also be used. By coating the solution on paper or various types of films, aimed heat-sensitive recording sheets can be obtained.

The amount of the metal salt derivative of nitrobenzoic acid, as well as the kind and the amount of various other ingredients for use in this invention are determined depending on the required performances and the recording properties with no particular restriction. However, in use of the metal salt derivative of nitrobenzoic acid in combination with other organic color-developing agent, it is usually appropriate to employ 3–10 parts of the organic color-developing agent, 1–8 parts of the metal salt derivative of nitrobenzoic acid and 1–20 parts of the filler per one part of the colorless basic dyestuff, and 10–25 parts of the binder for the total solid content. And in use of the metal salt derivative of nitrobenzoic acid as a color-developing agent, it is usually appropriate to employ 1–8 parts of the metal salt derivative of nitrobenzoic acid and 1–20 parts of the filler per one part of the colorless basic dyestuff, and 10–25 pars of the binder for the total solid content.

This invention will now be described more specifically referring to examples.

EXAMPLE 1

Solution A (liquid dispersion of dyestuff)

3-diethylamino6-methyl-(p-chloroanilino)fluoran: 1.5 parts
10% aqueous solution of polyvinyl alcohol: 3.4 parts
Water: 1.9 parts Solution B (liquid dispersion of color-developing agent)

4-hydroxybenzoic acid benzylester: 6 parts
Zinc stearate: 1.5 parts
Aqueous 10% solution of polyvinyl alcohol: 18.8 parts
Water: 11.2 parts Solution C (liquid dispersion)

Each of chemicals in Table 2: 1.0 parts
Aqueous 10% solution of polyvinyl alcohol: 2.5 parts
Water: 1.5 parts Each of the solutions having the foregoing compositions was ground in a ball mill into three micron particle sizes. Thereafter, the liquid dispersions was mixed at a ratio shown in Table 1 to form each of coating solutions.

TABLE 1

| | Composition of Coating Solution in Example 1 | | |
|---|---|---|---|
| | Sample of the present invention (1–6) | Comparative sample (1) | Comparative samples (2–12) |
| Solution A (dyestuff dispersion) | 6.8 parts | 6.8 parts | 6.8 parts |
| Solution B (developing agent dispersion) | 37.5 parts | 37.5 parts | 37.5 parts |
| Solution C | 5 parts | — | 5 parts |
| 50% calcium carbonate dispersion | 20 parts | 20 parts | 20 parts |

Each of the coating solutions was coated on one side of a paper substrate of 50 g/m$^2$ so as to provide a coating amount of 6.0 g/m$^2$ and was dried. The sheet was treated in a supercalender so as to obtain a smoothness of 200–300 seconds. The results of the quality performance tests carried out for the thus obtained black-color-developed heat-sensitive recording sheets are shown in Table 2.

TABLE 2

Results of Performance Test in Example 1

| | Stabilizer | Optical density(1) Untreated | Optical density(1) After oil(2) treatment | Optical density(1) Residual(3) density | Brightness of background(4) Untreated | Brightness of background(4) After oil(5) treatment | Brightness of background(4) Standing(6) at 60° C., 45% RH |
|---|---|---|---|---|---|---|---|
| Sample of the present invention | | | | | | | |
| 1 | Zinc salt derivative of 4-nitrobenzoic acid | 1.12 | 1.09 | 97 | 0.06 | 0.09 | 0.10 |
| 2 | Calcium salt derivative of 4-nitrobenzoic acid | 1.10 | 1.00 | 91 | 0.06 | 0.08 | 0.09 |
| 3 | Magnesium salt derivative of 4-nitrobenzoic acid | 1.11 | 0.99 | 89 | 0.06 | 0.08 | 0.09 |
| 4 | Zinc salt derivative of 3-nitrobenzoic acid | 1.10 | 1.00 | 91 | 0.07 | 0.09 | 0.11 |
| 5 | Calcium salt derivative of 3-nitrobenzoic acid | 1.09 | 0.99 | 91 | 0.07 | 0.09 | 0.11 |
| 6 | Magnesium salt derivative of 3-nitrobenzoic acid | 1.08 | 0.97 | 90 | 0.07 | 0.09 | 0.11 |
| Comparative samples | | | | | | | |
| 1 | None | 1.11 | 0.17 | 15.3 | 0.08 | 0.09 | 0.09 |
| 2 | Stearic acid | 1.12 | 0.15 | 13.4 | 0.08 | 0.09 | 0.11 |
| 3 | Zinc stearate | 1.10 | 0.17 | 15.5 | 0.07 | 0.09 | 0.10 |
| 4 | Calcium stearate | 1.07 | 0.16 | 15.0 | 0.07 | 0.09 | 0.11 |
| 5 | Terephthalic acid | 1.06 | 0.16 | 15.1 | 0.09 | 0.11 | 0.20 |
| 6 | Zinc terephthalate | 1.16 | 0.20 | 19.1 | 0.08 | 0.12 | 0.11 |
| 7 | Benzoic acid | 1.08 | 0.18 | 16.7 | 0.15 | 0.14 | 0.30 |
| 8 | Zinc benzoate | 1.10 | 0.60 | 54.5 | 0.08 | 0.15 | 0.36 |
| 9 | Calcium benzoate | 1.09 | 0.54 | 49.5 | 0.07 | 0.14 | 0.32 |
| 10 | t-Butylbenzoic acid | 1.09 | 0.19 | 17.4 | 0.13 | 0.10 | 0.29 |
| 11 | p-Methylbenzoic acid | 1.07 | 0.19 | 17.8 | 0.14 | 0.10 | 0.28 |
| 12 | o-Benzoybenzoic acid | 1.08 | 0.20 | 18.5 | 0.15 | 0.09 | 0.33 |

Note (1)Optical density:
Measured in a heat-sensitive facsimile apparatus CP 6000, manufactured by TOSHIBA CORPORATION, using a Macbeth densitometer for the portion of evenly printed black under the condition of mode (using RD-104 amber filter, which is also used in other examples).
Note (2)Optical density after oil treatment:
After spreading droplets of castor oil (0.8 mg) dropped on a glass plate by a syringe to 40 $cm^2$, they were transferred by a rubber seal of 1 cm × 1.5 cm to the surface printed and developed by the same procedures as (1) above. After leaving for seven days, the optical density in the transferred area was measured by a Macbeth densitometer.
Note (3)Residual density:
Calculated by the following equation $$\text{Residual density} = \frac{\text{Optical density after oil treatment}}{\text{Optical density not oil treated}} \times 100\ (\%)$$

Note (4)Brightness of background:
Not developed area was measured by a Macbeth densitometer.
Note (5)Brightness of background after oil treatment:
Castor oil droplets were transferred onto a not developed area in the same procedures as in (2). After leaving for three days, the density on the transferred area was measured by Macbeth densitometer.
Note (6)Brightness of background after treatment at 60° C., 45% relative humidity: After leaving for 24 hours under the severe conditions of 60° C. and 45% RH, a not developed area was measured by a Macbeth densitometer.

As is apparent from Table 2, Examples of the present invention using the metal salt derivative of nitrobenzoic acid show stable recorded images even contaminated with castor oils and possess more than 80% of residual rate for the optical density even leaving for seven days after contamination. Further, they show good stability for the brightness of background with less reduction in the brightness of background even for the oil contamination and preservation under severe conditions. Particularly, zinc salt derivative of nitrobenzoic acid for use in this invention possess high residual density even after oil contaminations.

EXAMPLE 2

A solution D was prepared by replacing 4-hydroxy benzoic acid benzylester in the solution B of Example 1 (liquid dispersion of color-developing agent) with the identical parts by weight of monobenzylphthalate, and the solution was mixed with the solution A, the solution C, and a calcium carbonate dispersion at ratio shown in Table 3.

TABLE 3

| | Composition of the Coating solution in Example 2: Samples of the present invention (7–12) | Comparative samples (15) | Comparative samples (16–26) |
|---|---|---|---|
| Solution A (dyestuff dispersion | 4.5 parts | 4.5 parts | 4.5 parts |
| Solution B (developing agent dispersion) | 9 parts | 9 parts | 9 parts |
| Solution C | 5 parts | — | 5 parts |
| 50% Calcium carbonate dispersion | 20 parts | 20 parts | 20 parts |

The results of quality performance tests for the black-color-developing heat-sensitive recording sheets obtained in the same manner as in Example 1 using each of the above solutions are shown in Table 4.

TABLE 4

Results of Performance Test in Example 2

| Stabilizer | Optical density Untreated | Optical density After oil treatment | Optical density Residual density (%) | Brightness of background Untreated | Brightness of background After oil treatment | Brightness of background Standing at 60° C. 45% RH |
|---|---|---|---|---|---|---|
| Sample of | | | | | | |

TABLE 4-continued

| | Stabilizer | Results of Performance Test in Example 2 | | | | | |
|---|---|---|---|---|---|---|---|
| | | Optical density | | | Brightness of background | | |
| | | Untreated | After oil treatment | Residual density (%) | Untreated | After oil treatment | Standing at 60° C. 45% RH |
| the present invention | | | | | | | |
| 7 | Zinc salt derivative of 4-nitrobenzoic acid | 1.11 | 1.05 | 95 | 0.07 | 0.09 | 0.11 |
| 8 | Calcium salt derivative of 4-nitrobenzoic acid | 1.10 | 1.02 | 93 | 0.07 | 0.09 | 0.10 |
| 9 | Magnesium salt derivative of 4-nitrobenzoic acid | 1.10 | 1.01 | 92 | 0.07 | 0.08 | 0.11 |
| 10 | Zinc salt derivative of 3-nitrobenzoic acid | 1.12 | 1.06 | 95 | 0.08 | 0.10 | 0.12 |
| 11 | Calcium salt derivative of 3-ntirobenzoic acid | 1.11 | 1.01 | 91 | 0.08 | 0.09 | 0.11 |
| 12 | Magnesium salt derivative of 3-nitrobenzoic acid | 1.11 | 1.01 | 91 | 0.08 | 0.09 | 0.11 |
| Comparative samples | | | | | | | |
| 15 | None | 1.09 | 0.16 | 14.7 | 0.07 | 0.08 | 0.10 |
| 16 | Stearic acid | 1.10 | 0.14 | 12.7 | 0.08 | 0.11 | 0.11 |
| 17 | Zinc stearate | 1.09 | 0.17 | 15.6 | 0.08 | 0.08 | 0.09 |
| 18 | Calcium stearate | 1.05 | 0.14 | 13.3 | 0.08 | 0.09 | 0.11 |
| 19 | Terephthalate | 1.10 | 0.18 | 16.4 | 0.10 | 0.13 | 0.20 |
| 20 | Zinc terephthalate | 1.10 | 0.18 | 16.4 | 0.10 | 0.13 | 0.20 |
| 21 | Benzoic acid | 1.06 | 0.17 | 16.0 | 0.14 | 0.16 | 0.28 |
| 22 | Zinc benzoate | 1.08 | 0.61 | 56.5 | 0.09 | 0.17 | 0.38 |
| 23 | Calcium benzoate | 1.07 | 0.50 | 46.7 | 0.08 | 0.16 | 0.37 |
| 24 | t-Butylbenzoic acid | 1.06 | 0.18 | 17.0 | 0.14 | 0.11 | 0.30 |
| 25 | p-Methylbenzoic acid | 1.06 | 0.18 | 17.0 | 0.13 | 0.11 | 0.31 |
| 26 | o-Benzoylbenzoic acid | 1.05 | 0.17 | 16.2 | 0.16 | 0.10 | 0.30 |

In Table 4, the effect of the metal salt derivative of nitrobenzoic acid according to the present invention is shown remarkably also in the case of using monobenzyl terephthalate, as the color-developing agent.

EXAMPLE 3

Solution A (liquid dispersion of dyestuff)

3-(N-ethyl-N-isoamyl)amino-6-methyl-7-anilinofluoran: 1.5 parts
10% aqueous solution of polyvinyl alcohol: 3.4 parts
Water: 1.9 parts Solution B (liquid dispersion of color-developing agent)

Each of color developing agents in Table 5: 6 parts
Benzyl p-benzyloxybenzoate: 3.0 parts
Zinc stearate: 1.5 parts
Aqueous 10% solution of polyvinyl alcohol: 26.3 parts
Water: 15.7 parts Solution C (liquid dispersion nitrobenzoic acid)

Zinc derivative of nitrobenzoic acid: 1.0 parts
Aqueous 10% solution of polyvinyl alcohol: 2.5 parts
Water: 1.5 parts Each of the solutions having the foregoing compositions was ground in an attritor into three micron particle size. Thereafter, the liquid dispersions was mixed at a ratio shown in following Table to form each of coating solutions.

TABLE

| | Composition of Coating Solution in Example 1 | |
|---|---|---|
| | Samples of the present invention (13–16) | Comparative samples (27–30) |
| Solution A (dyestuff dispersion) | 6.8 parts | 6.8 parts |
| Solution B (developing agent dispersion) | 52.5 parts | 52.5 parts |
| Solution C | 6 parts | — |
| 50% calcium carbonate dispersion | 20 parts | 20 parts |

The results of quality performance tests for the black-color-developing heat-sensitive recording sheets obtained in the same manner as in Example 1 using each of the above solutions are shown in Table 5.

TABLE 5

| | | Results of Performance Test in Example 3 | | | | | |
|---|---|---|---|---|---|---|---|
| | | Color developing agent | Optical density(1) | | | Brightness of background | |
| | | | Untreated | After oil treatment | Residual density (%) | Untreated | After oil treatment |
| Samples of the present invention | 13 | Benzyl 4-hydroxybenzoate | 1.21 | 1.15 | 95 | 0.07 | 0.09 |
| | 14 | Phthalic acid monobenzyl ester | 1.17 | 1.09 | 93 | 0.07 | 0.10 |
| | 15 | Bisphenol A | 1.07 | 0.82 | 77 | 0.09 | 0.11 |
| | 16 | Bis-(4-hydroxy-3-tert-butyl-6-methylphenyl) sulfide | 1.01 | 0.80 | 79 | 0.09 | 0.10 |

TABLE 5-continued

| | | Results of Performance Test in Example 3 | | | | |
|---|---|---|---|---|---|---|
| | | Color developing agent | Optical density[1] | | | Brightness of background | |
| | | | Untreated | After oil treatment | Residual density (%) | Untreated | After oil treatment |
| Comparative samples | 27 | Benzyl 4-hydroxybenzoate | 1.18 | 0.26 | 22 | 0.08 | 0.08 |
| | 28 | Phthalic acid monobenzyl ester | 1.16 | 0.25 | 22 | 0.08 | 0.08 |
| | 29 | Bisphenol A | 1.00 | 0.30 | 30 | 0.08 | 0.08 |
| | 30 | Bis-(4-hydroxy-3-tert-butyl-6-methylphenyl) sulfide | 1.01 | 0.60 | 59 | 0.08 | 0.09 |

As obviously seen from Table 5, zinc salt derivative of 4-nitrobenzoic acid provides stable recorded images, and particularly, very stable recorded images in use of 4-hydroxybenzoic acid ester or phthalic acid monoester as color developing agent.

EXAMPLE 4

Solution A (liquid dispersion of dyestuff)

3-Diethylamino-6-methyl-7-anilinofluoran: 2.0 parts
10% aqueous solution of polyvinyl alcohol: 4.6 parts
Water: 2.5 parts Solution B (liquid dispersion of color-developing agent)

Each of color developing agents in Table 6: 6 parts
10% aqueous solution of polyvinyl alcohol: 18.8 parts
Water: 11.2 parts Each of the solutions having the forgoing composition was ground in an attritor into three micron particle size. Thereafter, the liquid dispersions were mixed at a ratio shown in following Table to form each of coating solutions.

TABLE

| | Composition of Coating Solution in Example 4 | |
|---|---|---|
| | Samples of present invention (17 and 18) | Comparative samples (31–33) |
| Solution A (dyestuff dispersion) | 9.1 parts | 9.1 parts |
| Solution B (developing agent dispersion) | 36 parts | 36 parts |
| 50% Kaolin clay dispersion | 12 parts | 12 parts |

The results of quality performance tests for the black-color developing heat-sensitive recording sheets obtained in the same manner as in Example 1 using each of the above solutions are shown in Table 6.

TABLE 6

| | | Results of Performance Test in Example 4 | | | |
|---|---|---|---|---|---|
| | | | Optical density | | |
| | Sample No. | Color-developing agent | Untreated | After oil treatment | Residual density (%) |
| Samples of present invention | 17 | Zinc-salt derivative of 4-nitrobenzoic acid | 0.54 | 0.54 | 100 |
| | 18 | Zinc salt derivative of 4-nitrobenzoic acid | 0.61 | 0.73 | 120 |
| Comparative samples | 31 | Zinc benzoate | 0.20 | 0.06 | 30 |
| | 32 | Zinc terephthalate | 0.21 | 0.06 | 29 |
| | 33 | Bisphenol A | 0.94 | 0.16 | 17 |

As obviously seen from Table 6, metal salt derivative of nitrobenzoic acid provides stable recorded images against contamination with the oily substance.

EXAMPLE 5

Solution A (liquid dispersion of dyestuff)

Each of dyestuffs in Table 7: 2.0 parts
10% aqueous solution of polyvinyl alcohol: 4.6 parts
Water: 2.5 parts Solution B (liquid dispersion of color-developing agent)

Each of color developing agents in Table 7: 6 parts
10% aqueous solution of polyvinyl alcohol: 18.8 parts
Water: 11.2 parts Each of solutions having the foregoing composition was ground in an attritor into three micron particle size. Thereafter, the liquid dispersions were mixed at a ratio shown in following Table to form each of coating solutions.

TABLE

| | Composition of Coating Solution in Example 5 | |
|---|---|---|
| | Sample of the present invention (19–21) | Comparative samples (34–36) |
| Solution A (dyestuff dispersion) | 9.1 parts | 9.1 parts |
| Solution B (developing agent dispersion) | 36 parts | 36 parts |
| 50% Kaolin clay | 12 parts | 12 parts |

TABLE-continued

| | Composition of Coating Solution in Example 5 | |
|---|---|---|
| | Sample of the present invention (19–21) | Comparative samples (34–36) |
| dispersion | | |

The results of quality performance tests for the black-color developing heat-sensitive recording sheets obtained in the same manner as in Example 1 using each of the above solutions are shown in Table 7.

TABLE 7

Result of Performed Test in Example 5

| | Sample No. | Color-developing agent | Colorless beam dyestuff | Optical density: Untreated | Optical density: After oil treatment | Residual density (%) |
|---|---|---|---|---|---|---|
| Samples of present invention | 19 | Zinc salt derivative of 4-nitrobenzoic acid | Crystal violet lacton | 0.86 | 0.82 | 95 |
| | 20 | Zinc salt derivative of 4-nitrobenzoic acid | 3-(4-Diethylamino-2-ethoxyphenyl)-3-(1-ethyl-2-methylindol-3-yl)-4-azaphthalide | 0.88 | 0.84 | 95 |
| | 21 | Zinc salt-derivative of 4-nitrobenzoic acid | Fluorene type leuco dyestuff having the formula (III) | 0.52 | 0.51 | 98 |
| Comparative samples | 34 | Bisphenol A | Crystal violet lacton | 1.06 | 0.13 | 12 |
| | 35 | Bisphenol A | 3-(4-Diethylamino-2-ethoxyphenyl)-3-(1-ethyl-2-methylindol-3-yl)-4-azaphthalide | 1.14 | 0.46 | 40 |
| | 36 | Bisphenol A | Fluorene type leuco dyestuff having the formula (III) | 0.59 | 0.09 | 15 |

As obviously seen from Table 7, the use of metal salt derivative of nitrobenzoic acid as organic color-developing agent in combination with crystal violet lacton, azaphthalide type leuco dyestuff or fluorene type leuco dyestuff having the formula (III) or (IV) provides stable recorded images against contamination with the oily substance.

EXAMPLE 6

Solution A (liquid dispersion of dyestuff)

3-Diethylamino-6-methyl-7-anilinofluoran: 1.8 parts
10% aqueous solution of polyvinyl alcohol: 4.6 parts
Water: 2.5 parts Solution B (liquid dispersion of dyestuff 2)

Fluorene type leuco dyestuff having the formula (III): 0.9 parts
10% aqueous solution of polyvinyl alcohol: 2.3 parts
Water: 1.3 parts Solution C (liquid dispersion of color-developing agent)

Each of color-developing agents in Table 8: 6 parts
10% aqueous solution of polyvinyl alcohol: 18.8 parts
Water: 11.2 parts Each of the solutions having the forgoing composition was ground in an attritor into three micron particle size. Thereafter, the liquid dispersions were mixed at a ratio shown in following Table to form each of coating solutions.

TABLE

| | Composition of Coating Solution in Example 5: Sample of the present invention (22) | Sample of the present invention (23) | Comparative samples (37 and 38) |
|---|---|---|---|
| Solution A (dyestuff dispersion 1) | 8.9 parts | — | 8.9 parts |
| Solution B (dyestuff dispersion 2) | 4.5 parts | 4.5 parts | 4.5 parts |
| Solution C (developing) | 36 parts | 36 parts | 36 parts |
| 0% Kaolin clay dispersion | 12 parts | 12 parts | 12 parts |

The results of quality performance tests for the black-color developing heat-sensitive recording sheets obtained in the same manner as in Example 1 using each of the above solutions are shown in Table 8.

TABLE 8

Results of Performance Test in Example 6

| | Sample No. | Color-developing agent | Colorless basic dyestuffs: dyestuff dispersion 1 | Colorless basic dyestuffs: dyestuff disfersion 2 | Optical density: Untreated | Optical density: After oil treatment | Optical density: Residual density (%) | Reflectance of infrased ray (7) |
|---|---|---|---|---|---|---|---|---|
| Samples of | 22 | Zinc salt derivative | 3-Diethyl-amino-6- | Fluorene type | 0.78 | 0.78 | 100 | 30 |

TABLE 8-continued

| | Sample No. | Color-developing agent | Colorless basic dyestuffs: dyestuff dispersion 1 | Colorless basic dyestuffs: dyestuff disfersion 2 | Optical density: Untreated | Optical density: After oil treatment | Optical density: Residual density (%) | Reflectance of infrased ray (7) |
|---|---|---|---|---|---|---|---|---|
| present invention | | of 4-nitrobenzoic acid | methyl-7-anilinofluorane | leuco dyestuff having the formula (III) | | | | |
| | 23 | Zinc salt derivative of 4-nitrobenzoic acid | no Fluorene addition | 0.52 type leuco dyestuff having the formula (III) | 0.51 | 98 | 15 | |
| Comparative samples | 37 | Bisphenol A | 3-Diehtyl-amino-6-methyl-7-anilino-fluorane | Fluorene type leuco dyestuff having the formula (III) | 1.17 | 0.71 | 61 | 52 |
| | 38 | p-hydroxy-benzoic acid benzyl ester | 3-Diethyl-amino-6-methyl-7-anilino-fluorane | Fluorene type leuco dyestuff having the formula (III) | 1.23 | 0.26 | 21 | 70 |

Note 7. Reflectance of infrared ray:
The heat-sensitive recording sheets were recorded by using Bar-Cord-Printer TLP-150 (manufactured by F & O) with a pulse width of 4.0 mm and an impressed voltage of 30 V. the recorded image was measured by a spectrophotometer (using a wave length of 800 nm). Lower Reflectance indicates better Effect.

As obviously seen from Table 8, the combined use of the metal salt derivative of nitrobenzoic acid as color-developing agent and the fluorene type leuco dyestuff having the formula (III) as colorless basic dyestuff provides both better absorption of near infrared ray and more stable recorded images against contamination with the oily substance, in comparison with the combined use of other organic color-developing agent and dyestuff.

We claim:

1. Heat-sensitive recording sheet having a color forming layer comprising a colorless basic dyestuff and a organic color-developing agent, wherein said color-forming layer contains a metal salt derivative of nitrobenzoic acid having the general formula (I) or (II)

(I)

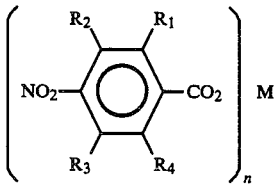

(II)

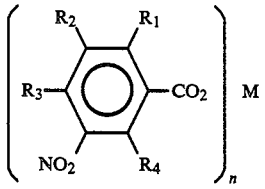

where $R_1$, $R_2$, $R_3$ and $R_4$ represent individually H, $NO_2$, halogen group, alkoxyl group, $CH_3$, $C_2H_5$, $C_3H_7$, iso-$C_3H_7$, tert-$C_4H_9$, $C_5H_{11}$ or

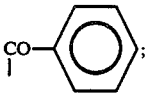

M represents a polyvalent metal; and n represents an integer of 2 or 3.

2. Heat-sensitive recording sheet according to claim 1, wherein said metal salt derivative of nitrobenzoic acid is a metal derivative of 4-nitrobenzoic acid.

3. Heat-sensitive recording sheet according to claim 1 or 2, wherein M in the formula (I) or (II) is at least one metal selected from the group consisting of zinc, calcium and magnesium.

4. Heat-sensitive recording sheet according to claim 3, wherein said metal salt derivative of nitrobenzoic acid is used as said organic color-developing agent.

5. Heat-sensitive recording sheet according to claim 3, wherein said metal salt derivative of nitrobenzoic acid is used said organic color-developing agent, and at least one substance selected from the group consisting of crystal violet lactone, azaphthalide type leuco dyestuff and fluorene type leuco dyestuff having the general formula (III) or (IV) is used as said colorless basic dyestuff:

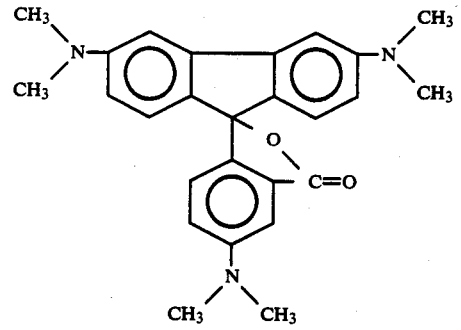

(III)

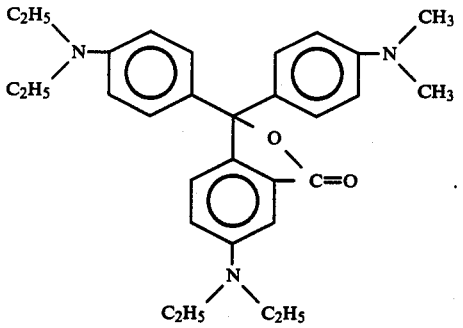

(IV)

6. Heat-sensitive recording sheet according to claim 3 wherein said color forming layer contains 1–8 parts by weight of said metal derivative of nitrobenzoic acid as color-developing agent, 1–20 parts by weight of filler per one part by weight of said colorless basic dyestuff, and 10–25 parts by weight of binder for total solid content of said layer.

7. Heat sensitive recording sheet according to claim 3 wherein at least one other substance than metal derivative of nitrobenzoic acid is used as said organic color-developing agent.

8. Heat-sensitive recording sheet according to claim 3 wherein at least one substance selected from the group consisting of monophenolic 4-hydroxyphenyl compound and phthalic acid monoester is used as said organic color-developing agent.

9. Heat-sensitive recording sheet according to claim 3 wherein said color forming layer contains 3–10 parts by weight of other organic color-developing agent than a metal derivative of nitrobenzoic acid, 1–8 parts of the metal salt derivative of nitrobenzoic acid, 1–20 parts by weight of filler per one part by weight of said colorless basic dyestuff, and 10–25 parts by weight of binder for total solid content of said color forming layer.

10. Heat-sensitive recording sheet according to claim 1 or 2 wherein said metal salt derivative of nitrobenzoic acid is used as said organic color-developing agent.

11. Heat-sensitive recording sheet according to claim 1 or 2 wherein said metal salt derivative of nitrobenzoic acid is used said organic color-developing agent, and at least one substance selected from the group consisting of crystal violet lactone, azaphthalide type leuco dyestuff and fluorene type leuco dyestuff having the general formula (III) or (IV) is used as said colorless basic dyestuff:

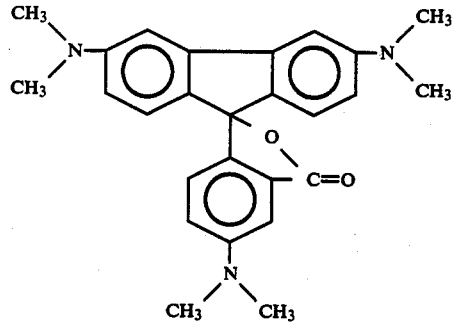

(III)

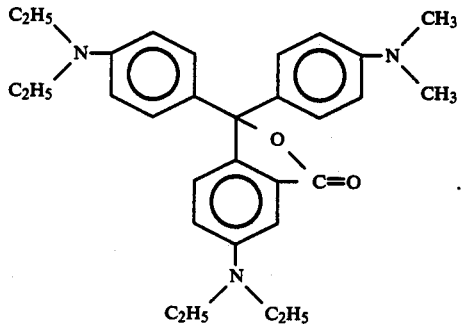

(IV)

12. Heat-sensitive recording sheet according to claim 1 or 2 wherein said color forming layer contains 1–8 parts by weight of said metal derivative of nitrobenzoic acid as color-developing agent, 1–20 parts by weight of filler per one part by weight of said colorless basic dyestuff, and 10–25 parts by weight of binder for total solid content of said layer.

13. Heat sensitive recording sheet according to claim 1 or 2 wherein at least one other substance than metal derivative of nitrobenzoic acid is used as said organic color-developing agent.

14. Heat-sensitive recording sheet according to claim 1 or 2 wherein at least one substance selected from the group consisting of monophenolic 4-hydroxyphenyl compound and phthalic acid monoester is used as said organic color-developing agent.

15. Heat-sensitive recording sheet according to claim 1 or 2 wherein said color forming layer contains 3–10 parts by weight of other organic color-developing agent than a metal derivative of nitrobenzoic acid, 1–8 parts of the metal salt derivative of nitrobenzoic acid, 1–20 parts by weight of filler per one part by weight of said colorless basic dyestuff, and 10–25 parts by weight of binder for total solid content of said color forming layer.

* * * * *